US009326056B2

(12) United States Patent
Neujahr

(10) Patent No.: US 9,326,056 B2
(45) Date of Patent: Apr. 26, 2016

(54) RECEPTACLE FOR LOW-VOLTAGE ELECTRONIC DEVICES

(71) Applicant: Steven Neujahr, St. Paul, MN (US)

(72) Inventor: Steven Neujahr, St. Paul, MN (US)

( * ) Notice: Subject to any disclaimer, the term of this patent is extended or adjusted under 35 U.S.C. 154(b) by 193 days.

(21) Appl. No.: 14/076,936

(22) Filed: Nov. 11, 2013

(65) Prior Publication Data

US 2015/0131841 A1 May 14, 2015

(51) Int. Cl.

| | |
|---|---|
| ***H04R 25/00*** | (2006.01) |
| ***H04R 1/02*** | (2006.01) |
| *H04R 1/20* | (2006.01) |
| *H04R 1/28* | (2006.01) |

(52) U.S. Cl.

CPC ..... *H04R 1/025* (2013.01); *H04R 1/2888* (2013.01); *H04R 2201/021* (2013.01); *H04R 2201/029* (2013.01)

(58) Field of Classification Search

CPC .... H04R 1/02; H04R 1/025; H04R 2201/029; H04R 1/2869; H04R 1/2873

USPC ..... 381/345, 361, 352, 160, 166; 181/175, 181/198, 199; 220/3.3, 3.2, 4.02, 3.5

See application file for complete search history.

(56) References Cited

U.S. PATENT DOCUMENTS

| | | | | |
|---|---|---|---|---|
| 3,495,276 | A | | 2/1970 | Charles |
| 3,884,280 | A | | 5/1975 | Chailer |
| 4,265,365 | A | | 5/1981 | Boteler |
| 4,388,890 | A | | 6/1983 | Wester et al. |
| 4,408,695 | A | | 10/1983 | Balkwill et al. |
| 4,438,859 | A | | 3/1984 | Solek |
| 4,626,617 | A | | 12/1986 | Rye |
| 4,641,345 | A | * | 2/1987 | Takahashi ..... 381/86 |
| 4,724,281 | A | | 2/1988 | Nix et al. |
| 4,757,158 | A | | 7/1988 | Lentz |
| 4,794,207 | A | | 12/1988 | Norberg et al. |
| 5,011,033 | A | | 4/1991 | Roth |
| 5,084,596 | A | | 1/1992 | Borsh et al. |
| 5,300,731 | A | | 4/1994 | DeBaratolo |
| 5,444,183 | A | | 8/1995 | Gehrs et al. |
| 5,463,533 | A | | 10/1995 | Donnerstag et al. |
| 5,476,183 | A | | 12/1995 | Harpenau |
| 5,550,322 | A | | 8/1996 | Tynan |
| 5,571,993 | A | | 11/1996 | Jones et al. |
| 5,573,321 | A | | 11/1996 | Bell |

(Continued)

FOREIGN PATENT DOCUMENTS

| | | | |
|---|---|---|---|
| GB | 2355593 | A | 4/2001 |

*Primary Examiner* — Ahmad F Matar
*Assistant Examiner* — Norman Yu
(74) *Attorney, Agent, or Firm* — Seager, Tufte & Wickhem LLP

(57) ABSTRACT

A low-voltage electronic device receptacle may include a back wall, one or more side walls extending from the back wall, and a flange extending outward from the one or more side walls, wherein the back wall includes a forwardly-extending generally convex protrusion making up greater than 10% of the back wall. An enclosure for installing a speaker in a building structure having first and second support members and an outer layer may include a receptacle including a back wall, one or more side walls, and a flange extending outwardly from the one or more side walls, wherein the receptacle may be positioned between the first and second support members, the back wall includes a generally convex protrusion extending toward the outer layer, and the speaker may be mounted to the outer layer and a portion of the speaker may deflect at least a portion of the protrusion away from the outer layer.

10 Claims, 5 Drawing Sheets

(56) References Cited

U.S. PATENT DOCUMENTS

| | | | | |
|---|---|---|---|---|
| 5,721,394 | A | 2/1998 | Mulks | |
| 5,739,481 | A * | 4/1998 | Baumhauer et al. | 181/148 |
| 5,744,753 | A | 4/1998 | Nattel | |
| 5,834,692 | A | 11/1998 | Lentz | |
| 5,959,246 | A | 9/1999 | Gretz et al. | |
| 6,031,181 | A | 2/2000 | Jacks et al. | |
| 6,066,803 | A | 5/2000 | Hagarty | |
| 6,166,329 | A | 12/2000 | Oliver et al. | |
| 6,194,657 | B1 | 2/2001 | Gretz | |
| 6,239,365 | B1 | 5/2001 | McEvers | |
| 6,290,190 | B1 | 9/2001 | Kendall | |
| 6,395,981 | B1 | 5/2002 | Ford | |
| 6,403,883 | B1 | 6/2002 | Morgan et al. | |
| 6,419,102 | B1 | 7/2002 | Harpenau | |
| 6,437,241 | B1 | 8/2002 | Neujahr | |
| 6,452,097 | B1 | 9/2002 | DeWall | |
| 6,660,936 | B1 | 12/2003 | Jacks | |
| 7,186,916 | B2 | 3/2007 | Jacks | |
| 7,476,805 | B2 | 1/2009 | Jacks | |
| 8,695,283 | B2 * | 4/2014 | Gagne et al. | 52/39 |
| 2004/0074658 | A1 | 4/2004 | Jacks | |
| 2007/0170086 | A1 * | 7/2007 | Jacks et al. | 206/701 |
| 2010/0050537 | A1 | 3/2010 | Murray | |
| 2012/0279777 | A1 | 11/2012 | Gagne et al. | |

* cited by examiner

RECEPTACLE FOR LOW-VOLTAGE ELECTRONIC DEVICES

FIELD OF THE INVENTION

The present invention relates generally to components for building construction. More particularly, the present invention relates to receptacles for enclosing low voltage electronic devices.

BACKGROUND OF THE INVENTION

With the rising cost of energy, efforts have been made to provide homes and other buildings with insulation which may more efficiently prevent temperature migration between the inside and the outside of buildings. Modern building techniques include the installation of a vapor barrier in the walls of homes or other buildings.

The vapor barrier may help prevent moisture and/or temperature migration. For example, if moist air from inside the building penetrates the vapor barrier, the moisture may condense inside the walls and ceilings of the building. This condensed moisture can promote mold growth and cause building materials to degrade. The loss of warm air from the inside of the building to the outside of the building may increase the cost of heating the structure. Similarly, intrusion of warm and/or moist air into a building from outside may increase cooling costs within the structure.

When mounting audio speakers, keypads, and/or other low voltage electronic devices in the wall or ceiling of a house or other building it is desirable to protect the low voltage electronic devices from exposure to dirt, debris from building materials, and other substances which may cause these devices to deteriorate. Installers who place low-voltage electronic devices in the walls of structures may sometimes use standard building materials to fabricate a "custom-built" enclosure at the installation site. To comply with modern building requirements, these custom-built enclosures must be substantially impervious to warm, moist air, and they must be sealingly connected to the existing vapor barrier of the structure. A great deal of skill is required to assemble an enclosure at a work site that will accomplish these goals. Even when an installer is highly skilled, this task is very time consuming.

SUMMARY OF THE INVENTION

A low-voltage electronic device receptacle may include a back wall, one or more side walls extending forwardly from the back wall, and a flange extending laterally outward from the one or more side walls, wherein the back wall includes a forwardly-extending generally convex protrusion, and wherein the protrusion comprises greater than 10% of the back wall.

An enclosure for installing a speaker in a building structure comprising first and second support members and an outer layer fixed to the first and second support members may include a receptacle including a back wall, one or more side walls, and a flange extending outwardly from the one or more side walls, wherein the receptacle is configured to be positioned between the first and second support members, and attached to both of the first and second support members using the flange, with the flange disposed between the first and second support members and the outer layer, wherein the back wall includes a generally convex protrusion extending toward the outer layer, and wherein the speaker is mounted to the outer layer and a portion of the speaker deflects at least a portion of the generally convex protrusion away from the outer layer.

Figure 1:
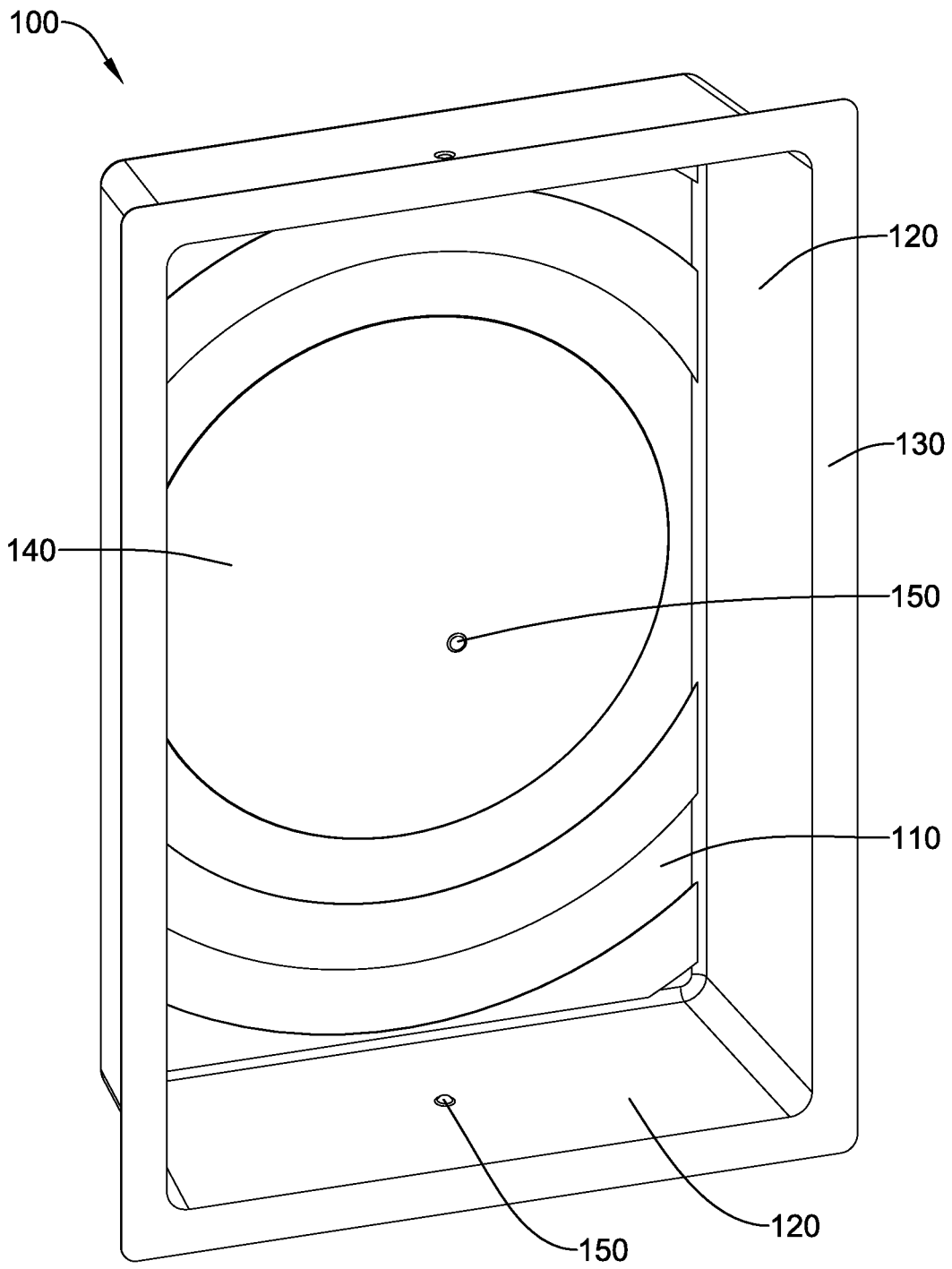
FIG. 1 is a perspective view of an example receptacle for enclosing low voltage electronic devices in a wall.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION OF THE INVENTION

The following description should be read with reference to the drawings, which are not necessarily to scale, wherein like reference numerals indicate like elements throughout the several views. The detailed description and drawings are intended to illustrate but not limit the claimed invention. Those skilled in the art will recognize that the various elements described and/or shown may be arranged in various combinations and configurations without departing from the scope of the disclosure. The detailed description and drawings illustrate example embodiments of the claimed invention.

For the following defined terms, these definitions shall be applied, unless a different definition is given in the claims or elsewhere in this specification.

All numeric values are herein assumed to be modified by the term "about," whether or not explicitly indicated. The term "about", in the context of numeric values, generally refers to a range of numbers that one of skill in the art would consider equivalent to the recited value (i.e., having the same function or result). In many instances, the term "about" may include numbers that are rounded to the nearest significant figure. Other uses of the term "about" (i.e., in a context other than numeric values) may be assumed to have their ordinary and customary definition(s), as understood from and consistent with the context of the specification, unless otherwise specified.

The recitation of numerical ranges by endpoints includes all numbers within that range, including the endpoints (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of one skilled in the art to effect such feature, structure, or characteristic in connection with other embodiments, whether or not explicitly described, unless clearly stated to the contrary. That is, the various individual elements described below, even if not explicitly shown in a particular combination, are nevertheless contemplated as being combinable or arrangable with each other to form other additional embodiments or to complement and/or enrich the described embodiment(s), as would be understood by one of ordinary skill in the art.

Reference is now made to the figures, in which like element numbers refer to like elements throughout the several views. FIG. 1 illustrates an example receptacle 100. In some embodiments, the receptacle 100 may include a back wall 110 and one or more side walls 120 fixedly attached to the back wall 110. In some embodiments, the one or more side walls 120 may extend forwardly from the back wall 110 at an outer edge or edges thereof. In some embodiments, the one or more side walls 120 may be a single continuous sidewall. In some embodiments, the one or more side walls 120 may include a plurality of discrete side walls, wherein each side wall 120 may be joined to one or more adjacent side walls 120. In some embodiments, the one or more side walls 120 may include two side walls, three side walls, four wide walls, five side walls, six side walls, or more side walls as desired. As will be easily understood, the one or more side walls 120 may collectively define an outer perimeter having a shape, which may correspond to the number of side walls in some embodiments. For example, the outer perimeter may be round, ovoid or egg-shaped, triangular, square or rectangular, pentagonal, hexagonal, irregularly-shaped, or other suitable shapes as desired.

In some embodiments, a flange 130 may extend laterally outward from the one or more side walls 120. In some embodiments, the flange 130 may be attached to the one or more side walls 120 at a forwardmost edge of the one or more side walls 120. In some embodiments, the flange 130 may be oriented substantially parallel to the back wall 110. In some embodiments, the flange 130 may be one or more flanges extending laterally outward from one or more of the one or more side walls 120. In some embodiments, the flange 130 may be one or more flanges extending laterally outward from more than one of the one or more side walls 120. In some embodiments, the flange 130 may be one or more flanges extending laterally outward from each of the one or more side walls 120. In some embodiments, the flange 130 may be one continuously circumferential flange extending laterally outward from each of the one or more side walls 120. In some embodiments, the flange 130 may extend about or around the outer perimeter. In some embodiments, the flange 130 may have an outside perimeter and/or shape that corresponds to (i.e., is aligned with, is parallel to, etc.) the outer perimeter and/or shape of the one or more side walls 120. In some embodiments, the outside perimeter of the flange 130 may have a shape that is different from shape of the outer perimeter of the one or more side walls 120. For example, a receptacle having a round or ovoid outer perimeter may have a square or rectangular outside perimeter. Other configurations and/or combinations of shapes are also contemplated.

In some embodiments, the back wall 110, the one or more side walls 120, and the flange 130 may cooperate to form a barrier impervious to fluids. In some embodiments, the fluids may be one or more of gases (i.e., air, oxygen, carbon dioxide, etc.), vapors (i.e., water vapor, etc.), and/or liquids (i.e., water, etc.). In some embodiments, the back wall 110, the one or more side walls 120, and/or the flange 130 may be integrally formed as a single piece by, for example, injection molding, rotomolding, vacuum forming or molding, stamping, or other suitable means or processes. In other words, the back wall 110, the one or more side walls 120, and/or the flange 130, may be unitary and/or formed from a common piece of material. In some embodiments, the back wall 110, the one or more side walls 120, and/or the flange 130 may be formed as separate pieces and later joined together to form the receptacle 100 by, for example, welding (friction welding, vibration welding, laser welding, etc.), adhesive bonding, mechanical assembly or attachment, or other suitable means.

Figure 2:
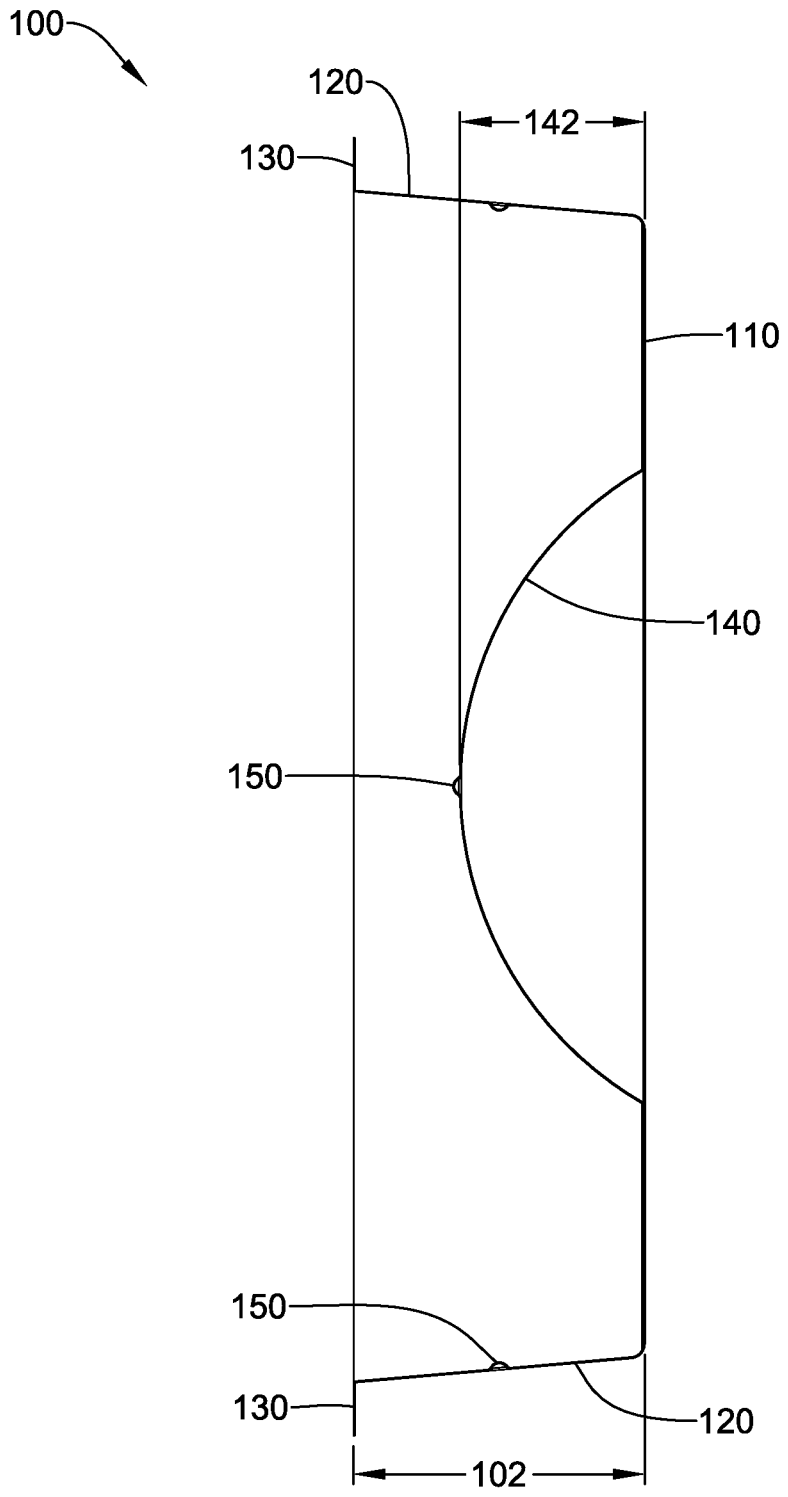
FIG. 2 is a side cross-sectional view of an example receptacle for enclosing low voltage electronic devices in a wall.

In some embodiments, the back wall 110 may include a forwardly-extending rounded or generally convex protrusion 140, as illustrated in FIGS. 1 and 2, for example. In some embodiments, the forwardly-extending generally convex protrusion 140 may have a vertex disposed forwardly of the back wall 110. In some embodiments, the rounded or generally convex protrusion 140 may at least partially define a space that resembles a spherical cap or a surface that resembles a paraboloid. In some embodiments, the generally convex protrusion 140 may be disposed within an interior space bounded by the one or more side walls 120. In some embodiments, the generally convex protrusion 140 may comprise greater than 10% of the back wall 110. In some embodiments, the generally convex protrusion 140 may comprise greater than 20% of the back wall 110. In some embodiments, the generally convex protrusion 140 may comprise greater than 30% of the back wall 110. In some embodiments, the generally convex protrusion 140 may comprise greater than 40% of the back wall 110. In some embodiments, the generally convex protrusion 140 may comprise 50% or more of the back wall 110. In some embodiments, the generally convex protrusion 140 may be substantially centered within the back wall 110. In some embodiments, the generally convex protrusion 140 may be offset from a center of the back wall 110.

In some embodiments, a receptacle depth 102 may be defined as a distance from the flange 130 to the back wall 110, measured normal or perpendicular to the back wall 110, as shown for example, in FIG. 2. In most embodiments, the receptacle depth 102 may be fixed. However, in some embodiments, the receptacle depth 102 may be adjustable. In some embodiments, the receptacle depth 102 may be about 1.5 inches to about 11.5 inches, about 2.0 inches to about 9.5 inches, about 2.5 inches to about 7.5 inches, or about 3.0 inches to about 5.5 inches.

Similarly, a device depth 142 may be defined as a distance from the flange 130 to a center of the generally convex protrusion 140, measured normal or perpendicular to the back wall 110. In most embodiments, the device depth 142 may be adjustable. However, in some embodiments, the device depth 142 may be fixed. In some embodiments, the device depth 142 may be adjustable from less than the receptacle depth 102 to more than the receptacle depth 102. In some embodiments, the receptacle depth 102 may be fixed and the device depth 142 may be adjustable. In some embodiments, the device depth 142 may be adjustable between about 0% and about 200% of the receptacle depth 102. In some embodiments, the device depth 142 may be adjustable between about 20% and about 180% of the receptacle depth 102. In some embodiments, the device depth 142 may be adjustable between about 30% and about 170% of the receptacle depth 102. In some embodiments, the device depth 142 may be adjustable between about 40% and about 160% of the receptacle depth 102. In some embodiments, the device depth 142 may be adjustable between about 50% and about 150% of the receptacle depth 102. In some embodiments, the device depth 142 may be adjustable between about 60% and about 140% of the receptacle depth 102. In some embodiments, the device depth 142 may be adjustable between about 70% and about 130% of the receptacle depth 102. In some embodiments, the device depth 142 may be adjustable between about 80% and about 120% of the receptacle depth 102. In some embodiments, the device depth 142 may be adjustable between about 90% and about 110% of the receptacle depth 102.

In some embodiments, the back wall 110 may include a corrugated pattern of concentric ridges and valleys. In some embodiments, for example as seen in FIG. 1, the corrugated pattern of concentric ridges and valleys may be generally aligned with and/or centered about a center of the back wall 110. In some embodiments, the corrugated pattern of concentric ridges and valleys may be generally aligned with and/or centered about the generally convex protrusion 140. It should be understood that other geometric shapes could be chosen for the corrugated pattern without deviating from the spirit or scope of this disclosure. For example, in some embodiments, the corrugated pattern may be a pattern of polygons, such as triangles or squares.

In use, the receptacle 100 may be installed behind an outer layer of a building or structure, as will be described further below, without a low-voltage electronic device initially installed. When an installer later begins to install a low-voltage electronic device, the installer first drills or cuts a hole through the outer layer in the general area of the center of receptacle 100. Once the hole has been made, the corrugated pattern may be visible through the hole, thereby providing a visual indicator as to the location of the center of the receptacle. The installer may then cut the necessary opening in the outer layer to install the low-voltage electronic device. In some embodiments, an audio speaker may be installed. In embodiments utilizing an audio speaker, it may be advantageous to locate the audio speaker as close as possible to the center of the receptacle 100 for acoustic reasons. Other reasons may also become apparent from the present disclosure.

The corrugated pattern of concentric ridges and valleys may be created on the back wall 110 using a variety of techniques. For example, the corrugated pattern of concentric ridges and valleys may be molded with a series of raised lines which constitute the corrugated pattern of concentric ridges and valleys. In some embodiments, the corrugated pattern of concentric ridges and valleys may be printed on a label and the label could be adhered to the back wall 110. In some embodiments, the corrugated pattern of concentric ridges and valleys may also be printed directly onto the back wall 110 using conventional printing methods such as pad printing or screen printing.

As discussed above, in some embodiments, the corrugated pattern of concentric ridges and valleys may be formed by alternating ridges and valleys in the back wall 110 (as best seen in FIG. 1). The ridges and valleys may stiffen the back wall 110 in addition to creating the corrugated pattern of concentric ridges and valleys. Stiffening of the back wall 110 may be particularly valuable when the receptacle 100 is used to house an audio speaker. If the back wall 110 was substantially flexible, an audio speaker may cause it to vibrate, resonate, and/or create undesirable noise.

The receptacle 100 may be made from any substantially rigid material. In some embodiments, a preferred material for the receptacle 100 may be a thermoplastic material such as acrylonitrile butadiene styrene (ABS) or polyvinylchloride (PVC). Thermoplastic materials may be generally low in cost and may be easily fabricated using conventional injection molding or thermoforming processes. In some embodiments, a flame-retardant thermoplastic material may be desirable. Other suitable polymers may also be used.

Some examples of suitable polymers may include high-density polyethylene (HDPE), polytetrafluoroethylene (PTFE), ethylene tetrafluoroethylene (ETFE), fluorinated ethylene propylene (FEP), polyoxymethylene (POM, for example, DELRIN® available from DuPont), polyether block ester, polyurethane (for example, Polyurethane 85A), polypropylene (PP), polyether-ester (for example, ARNITEL® available from DSM Engineering Plastics), ether or ester based copolymers (for example, butylene/poly(alkylene ether) phthalate and/or other polyester elastomers such as HYTREL® available from DuPont), polyamide (for example, DURETHAN® available from Bayer or CRISTAMID® available from Elf Atochem), elastomeric polyamides, block polyamide/ethers, polyether block amide (PEBA, for example available under the trade name PEBAX®), ethylene vinyl acetate copolymers (EVA), silicones, polyethylene (PE), Marlex high-density polyethylene, Marlex low-density polyethylene, linear low density polyethylene (for example REXELL®), polyester, polybutylene terephthalate (PBT), polyethylene terephthalate (PET), polytrimethylene terephthalate, polyethylene naphthalate (PEN), polyetheretherketone (PEEK), polyimide (PI), polyetherimide (PEI), polyphenylene sulfide (PPS), polyphenylene oxide (PPO), poly paraphenylene terephthalamide (for example, KEVLAR®), polysulfone, nylon, nylon-12 (such as GRILAMID® available from EMS American Grilon), perfluoro(propyl vinyl ether) (PFA), ethylene vinyl alcohol, polyolefin, polystyrene, epoxy, polyvinylidene chloride (PVdC), poly(styrene-b-isobutylene-b-styrene) (for example, SIBS and/or SIBS 50A), polycarbonates, ionomers, other suitable materials, or mixtures, combinations, copolymers thereof, polymer/metal composites, and the like.

Figure 3:
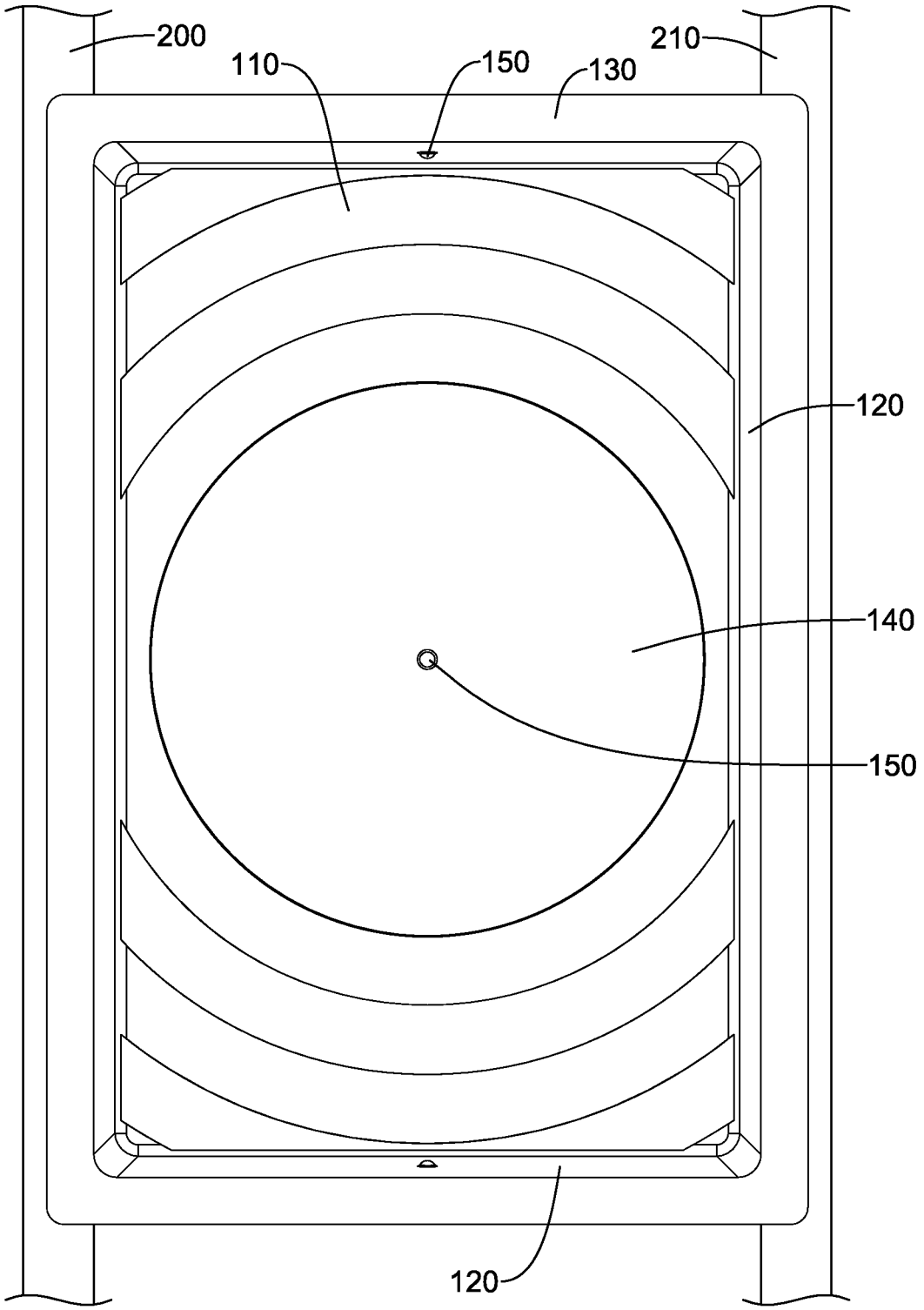
FIG. 3 is a plan view of an example receptacle positioned between two support members.

In some embodiments, the receptacle 100 may include a plurality of wire locator dimples 150. As best seen in FIGS. 1-3, the plurality of wire locator dimples 150 may each be formed as a localized projection formed from the same material as the receptacle 100. In some embodiments, the plurality of wire locator dimples 150 may be formed coextensively with their respective walls of the receptacle 100. In some embodiments, at least one of the plurality of wire locator dimples 150 may be disposed on or be formed as a part of the generally convex protrusion 140. It should be noted that the at least one of the plurality of wire locator dimples 150 disposed on or formed as a part of the generally convex protrusion 140 may be distinctly identifiable from the generally convex protrusion 140. In other words, the at least one of the plurality of wire locator dimples 150 disposed on or formed as a part of the generally convex protrusion 140 may be considered to be a separate structural feature of the receptacle 100 from the generally convex protrusion 140. In some embodiments, the material thickness of the plurality of wire locator dimples 150 may be generally thinner that the material thickness of the one or more side walls 120 and/or the back wall 110. As will be easily understood, the receptacle 100 may include any suitable number, size, and/or placement of the wire locator dimples, and the receptacle 100 is not limited only to the exemplary configurations illustrated. For example, in some embodiments, the receptacle 100 may include only one wire locator dimple 150, two wire locator dimples 150, three wire locator dimples, four wire locator dimples, five wire locator dimples, or more wire locator dimples. In some embodiments, there may be more than one wire locator dimple 150

(i.e., two wire locator dimples 150, three wire locator dimples 150, four wire locator dimples 150, etc.) on a selected side wall 120 and/or back wall 110. In some embodiments, there may be no wire locator dimples 150 on one, some, or all side walls 120 and/or back wall 110.

The plurality of wire locator dimples 150 may be useful for creating a hole or holes allowing a wire or wires to pass through one or more walls of the receptacle 100. For example, if an installer intends to pass wire through one of the one or more side walls 120, a knife or other cutting tool may be used to cut off the one of the plurality of wire locator dimples 150 located on the desired side wall 120. Cutting off the wire locator dimple 150 creates a small hole in the side wall 120. When installing a low-voltage electronic device in the receptacle 100, a wire or wires (i.e., electrical, speaker wire, telephone, coaxial cable, computer network, etc.) may be installed through this hole. When the desired length of wire is installed through the hole, the hole may be sealed using any commercially available sealant such as silicone caulk, acrylic caulk, or other suitable material. Sealing the hole that allows the wire(s) to enter the receptacle 100 is necessary in order to maintain a continuous vapor barrier. The plurality of wire locator dimples 150 allow an installer to quickly create a small hole of generally uniform size and shape. Accordingly, only a small amount of sealing material may be required to seal this small hole after the wire(s) are positioned. This may save time for the installer and may improve the integrity of the vapor barrier.

In some embodiments, the receptacle 100 may include a layer of pressure sensitive adhesive or tape applied to the flange 130. The layer of pressure sensitive adhesive or tape may be covered with a release liner to prevent the layer of pressure sensitive adhesive or tape from adhering to any objects while the receptacle 100 is transported and/or stored prior to use. In some embodiments, the release liner may include a layer of paper or plastic film treated with a release agent. In some embodiments, the layer of pressure sensitive adhesive or tape applied to the flange 130 may be used to seal the receptacle to a vapor barrier disposed over the receptacle 100.

Figure 4:
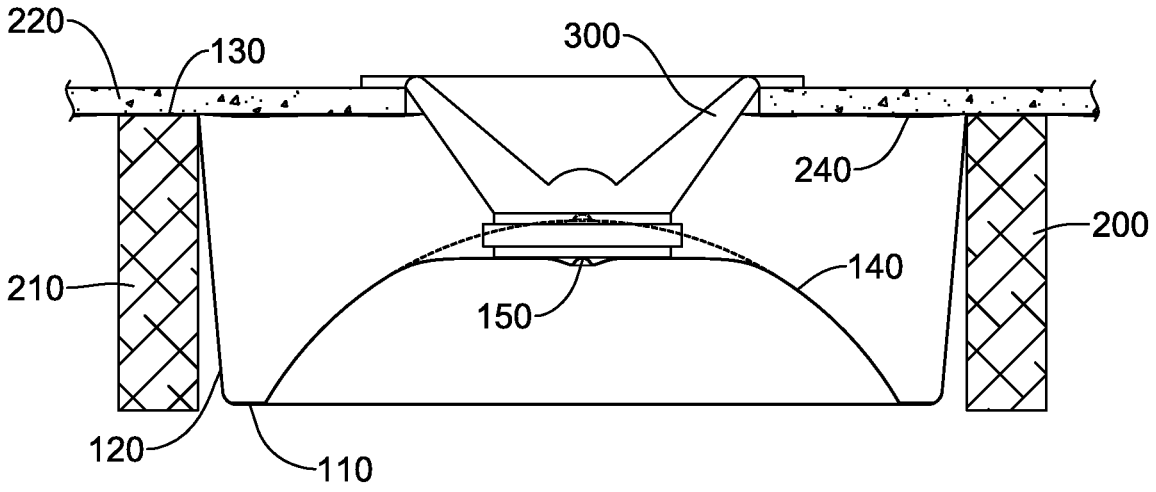
FIG. 4 is a top cross-sectional view of an example receptacle positioned between two support members with a speaker installed therein.
Figure 5:
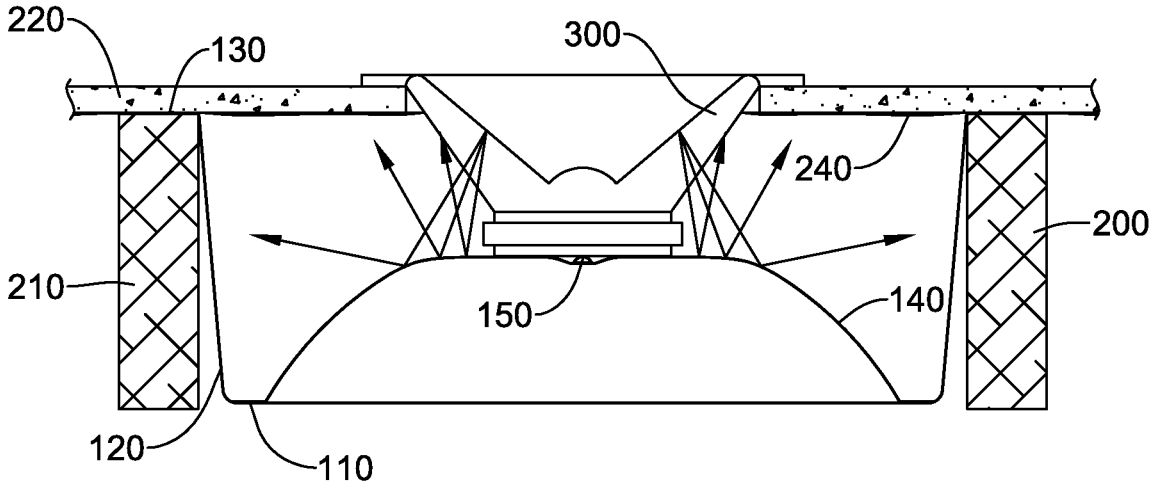
FIG. 5 is a top cross-sectional view of an example receptacle positioned between two support members with a speaker installed therein.

In some embodiments, the disclosure may include an enclosure for installing a speaker in a building structure. In some embodiments, a building structure such as a wall or ceiling may include a first support member 200, a second support member 210, and/or an outer layer 220 fixed to the first support member 200 and the second support member 210, as illustrated for example, in FIGS. 3-5. In some embodiments, the first support member 200 and the second support member 210 may be wall studs, ceiling or floor joists, and/or other suitable members. In some embodiments, the first support member 200 and the second support member 210 may be oriented vertically. In some embodiments, the first support member 200 and the second support member 210 may be oriented horizontally. In some embodiments, one of the first support member 200 and the second support member 210 may be oriented vertically, and the other of the first support member 200 and the second support member 210 may be oriented horizontally. In some embodiments, the first support member 200 and the second support member 210 may be formed from a number of commonly used building materials including steel, aluminum, and/or wood, or other suitable materials. A number of materials may also be used to fabricate the outer layer 220 including plaster, wood, acoustic tiles, gypsum board, and/or a wood fiber composite material. In the art, gypsum board is sometimes referred to as drywall, or by the trademarked brand name SHEETROCK. An outer layer 220 may be fixedly and/or removably attached to the first support member 200 and/or the second support member 210 using nails, screws, staples, adhesives, or other suitable means.

In some embodiments, a barrier film or vapor barrier 240 may be positioned directly behind the outer layer 220. In some embodiments, the barrier film or vapor barrier 240 may be any low cost, thin material which is substantially impervious to fluids, such as air or gases, water vapor, and/or liquids, etc. The barrier film or vapor barrier 240 may be positioned within a building structure such as a wall or ceiling to prevent temperature and/or moisture migration between the inside of the building and the outside of the building. To accomplish this goal completely, any holes made in the barrier film or vapor barrier 240 are preferably completely sealed. In the art, the walls and/or ceiling of a building are typically assembled to include a continuous sealed layer which is comprised of multiple sheets of the barrier film or vapor barrier 240 sealingly attached along their edges. In the art, this continuous sealed layer is referred to as the vapor barrier. An objective of the present disclosure is to provide a means for installing low-voltage electronic devices in a building structure such as a wall or ceiling while maintaining the integrity of the vapor barrier.

In some embodiments, the receptacle 100 may be capable of and/or configured to be positioned between and/or along the first and second support members 200, 210 so that the flange(s) 130 overlap the first and second support members 200, 210. The receptacle 100 may be attached to one or both of the first and second support members 200, 210 using a plurality of fasteners (i.e., staples, screws, nails, rivets, etc.) to affix the flange(s) 130 to the first and second support members 200, 210. It should be understood that other fasteners may be used without departing from the spirit and scope of the disclosure. As may be seen in FIGS. 4 and 5, an outer layer 220 may be positioned over the receptacle 100, such that the flange(s) 130 may be disposed between the first and second support members 200, 210 and the outer layer 220. In some embodiments, a barrier film or vapor barrier 240 may be disposed between the outer layer 220 and the receptacle 100. In some embodiments, the barrier film or vapor barrier 240 may be sealingly connected and/or adhered to the flange(s) 130, thereby maintaining the integrity of the vapor barrier when the barrier film or vapor barrier 240 is breached to access an interior of the receptacle 100.

In some embodiments, the length of each of the one or more side walls 120 may be selected so that the receptacle 100 will fit between first and second support members 200, 210 which have be placed a distance apart which is commonly used in the art. For example, in some embodiments, the length of two opposing side walls may be selected so that the receptacle 100 will fit between first and second support members 200, 210 which have been placed on 16 inch centers, and the length of two other opposing side walls may be selected so that the receptacle 100 will fit between first and second support members 200, 210 which have been placed on 24 inch centers. Other sizes, dimensions, and uses are also contemplated.

In some embodiments, the enclosure may include a speaker 300 mounted to the outer layer 220. In some embodiments, the speaker 300 may be mounted to one or more mounting brackets optionally disposed within the receptacle 100 or secured to the first support member 200 and/or the second support member 210. Other mounting or securing means are also possible. In some embodiments, at least a portion of the speaker 300 may directly contact and/or deflect at least a portion of the generally convex protrusion 140 in a direction away from the outer layer 220, as illustrated for example in FIG. 4. In some cases, having at least a portion of the speaker 300 directly contact the generally convex protrusion 140 may reduce or eliminate vibration and/or resonance of the back wall 110.

In some embodiments, the adjustability of the device depth 142 defined by the generally convex protrusion 140 may permit a variety of different sizes and/or types of the speaker 300 to be installed within the enclosure. Additionally, in some embodiments, the adjustability of the device depth 142 defined by the generally convex protrusion 140 may permit the installation of a larger and/or deeper speaker than previously possible with a receptacle having a fixed back wall and/or receptacle depth, such as that disclosed in U.S. Pat. No. 7,476,805, herein incorporated by reference in its entirety.

In some embodiments, the generally convex protrusion 140 may provide acoustical benefits to the receptacle 100 and/or the enclosure(s) described herein. When a speaker 300 is disposed over a receptacle 100, for example, sound waves emitted by the speaker 300 may reflect off of the back wall 110 toward the speaker 300. In some cases, sound waves reflected directly back toward the speaker inside the enclosure may create resonance and/or may result in cancellation of certain sound waves, thereby reducing the quality and/or volume of sound emitted forward of the enclosure and/or the speaker 300. Implementation of the construction described by the present disclosure may result in sound waves emitted by the speaker 300 being reflected in a plurality of directions away from the speaker 300 within the enclosure by the generally convex protrusion 140. In other words, the generally convex protrusion 140 may be configured to cause sound waves to be reflected or scattered within the enclosure, as illustrated for example in FIG. 5, thereby avoiding resonance and/or cancellation, instead of those sound waves being reflected directly back toward the speaker 300 by the back wall 110.

Additionally, in some embodiments, the generally convex protrusion 140 may be thinner and/or more flexible than the surrounding back wall 110 to provide adjustability in the device depth 142. However, the shape and/or structure of the generally convex protrusion 140 may be configured to provide a resistance to vibration and/or resonance of the back wall 110 and/or the generally convex protrusion 140.

When using a receptacle 100 and/or enclosure as described herein to enclose a low-voltage electronic device (i.e., speaker 300, etc.) and maintain the integrity of a vapor barrier, a method may include some or all of the following steps:

1. Choose which of the plurality of wire locator dimples 150 is the most convenient place for wire(s) to enter the receptacle 100.
2. Cut off the appropriate wire locator dimple to create a wire entry hole.
3. Position the receptacle 100 within a wall or ceiling so the flange 130 is in direct contact with at least one of the first and second support members 200, 210.
4. Secure the flange 130 to the at least one of the first and second support members 200, 210.
5. Thread wire(s) through the wire entry hole in the receptacle 100.
6. Place a barrier film or vapor barrier 240 over the first and second support members 200, 210 and the receptacle 100.
7. Seal the barrier film or vapor barrier 240 to the flange 130 of the receptacle 100.
8. Complete the assembly of the wall or ceiling by positioning an outer layer 220 over the barrier film or vapor barrier 240.
9. Connect a radio frequency transmitter to the wire(s).
10. Use a radio frequency receiver to determine the approximate location of the end(s) of the wire(s); in this approximate location, create a hole through the barrier film or vapor barrier 240 and the outer layer 220.
11. Visually examine the corrugated pattern of ridges and valleys to determine the center of the receptacle 100.
12. Enlarge the hole toward the center of the receptacle 100 as needed to accommodate a low-voltage electronic device being installed, preferably centering or aligning the hole with the center of the receptacle 100 and/or the generally convex protrusion 140.
13. Reach inside the hole and retrieve the wire(s) by grasping the end(s) of the wire(s).
14. Pull out the desired length of wire(s) and attach the end(s) of the wire(s) to the low-voltage electronic device which is being installed.
15. Seal the wire entry hole in the receptacle 100 using an appropriate sealant.
16. Install the low-voltage electronic device against the generally convex protrusion 140, deflecting the generally convex protrusion 140 away from the outer layer 220 as needed to accommodate the low-voltage electronic device.
17. Complete the installation by securing the low-voltage electronic device to the outer layer 220.

In some embodiments, one or more of the steps may be optional and/or excluded from the method. In some embodiments, additional steps, repetition of some or all steps, and/or modifications to the steps described above may be made within the scope of the present disclosure.

It should be understood that this disclosure is, in many respects, only illustrative. Changes may be made in details, particularly in matters of shape, size, and arrangement of steps without exceeding the scope of the invention. This may include, to the extent that it is appropriate, the use of any of the features of one example embodiment being used in other embodiments. The invention's scope is, of course, defined in the language in which the appended claims are expressed.

What is claimed is:

1. An enclosure for installing a speaker in a building structure comprising first and second support members and an outer layer fixed to the first and second support members, the enclosure comprising:

a receptacle including a back wall, one or more side walls, and a flange extending outwardly from the one or more side walls;

wherein the receptacle is configured to be positioned between the first and second support members, and attached to both of the first and second support members using the flange, with the flange disposed between the first and second support members and the outer layer;

wherein the back wall includes a generally convex protrusion extending toward the outer layer;

wherein the speaker is mounted to the outer layer and a portion of the speaker deflects at least a portion of the generally convex protrusion away from the outer layer;

wherein sound waves emitted by the speaker are reflected in a plurality of directions away from the speaker within the enclosure by the generally convex protrusion.

2. The enclosure of claim 1, wherein the protrusion comprises greater than 10% of the back wall.

3. The enclosure of claim 2, wherein the protrusion comprises greater than 20% of the back wall.

4. The enclosure of claim 3, wherein the protrusion comprises greater than 30% of the back wall.

5. The enclosure of claim 1, wherein the back wall includes a corrugated pattern of concentric ridges and valleys centered about the generally convex protrusion.

6. The enclosure of claim 1, wherein the back wall, the one or more side walls, and the flange cooperate to form a barrier impervious to fluids.

7. The enclosure of claim 6, wherein the fluids include one or more of the following: gases, vapors, or liquids.

8. The enclosure of claim 1, wherein a receptacle depth is defined as a distance from the outer layer to the back wall normal to the back wall;

wherein a device depth is defined as a distance from the outer layer to a center of the protrusion normal to the back wall; and wherein the receptacle depth is fixed and the device depth is adjustable.

9. The enclosure of claim 1, further including a vapor barrier disposed between the outer layer and the receptacle.

10. The enclosure of claim 9, wherein the vapor barrier is sealingly connected to the flange.

* * * * *